US007486014B2

(12) United States Patent
Hwang et al.

(10) Patent No.: US 7,486,014 B2
(45) Date of Patent: Feb. 3, 2009

(54) ELECTRON EMISSION DEVICE AND ELECTRON EMISSION DISPLAY USING THE ELECTRON EMISSION DEVICE

(75) Inventors: Seong-Yeon Hwang, Yongin-si (KR); Seung-Hyun Lee, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 12 days.

(21) Appl. No.: 11/443,067

(22) Filed: May 31, 2006

(65) Prior Publication Data

US 2006/0267471 A1 Nov. 30, 2006

(30) Foreign Application Priority Data

May 31, 2005 (KR) ..... 10-2005-0046201

(51) Int. Cl.
*H01J 1/30* (2006.01)

(52) U.S. Cl. ..... 313/496; 313/495; 313/497

(58) Field of Classification Search ..... 313/491–497, 313/414, 346 R

See application file for complete search history.

(56) References Cited

U.S. PATENT DOCUMENTS

| | | | | |
|---|---|---|---|---|
| 5,708,327 | A * | 1/1998 | O'Boyle | 313/495 |
| 6,437,503 | B1 * | 8/2002 | Konuma | 313/495 |
| 6,630,556 | B2 * | 10/2003 | Tomida et al. | 526/264 |
| 6,972,513 | B2 * | 12/2005 | Shiratori et al. | 313/309 |
| 2003/0127965 | A1 * | 7/2003 | Uemura et al. | 313/495 |
| 2004/0012327 | A1 * | 1/2004 | Shiratori et al. | 313/497 |
| 2005/0110394 | A1 * | 5/2005 | Lee et al. | 313/497 |
| 2005/0184647 | A1 * | 8/2005 | Chang | 313/497 |
| 2005/0242707 | A1 * | 11/2005 | Hwang | 313/497 |
| 2006/0055311 | A1 * | 3/2006 | Jung et al. | 313/496 |

* cited by examiner

*Primary Examiner*—Nimeshkumar D Patel
*Assistant Examiner*—Christopher M Raabe
(74) *Attorney, Agent, or Firm*—Lee & Morse, P.C.

(57) ABSTRACT

An electron emission device includes a first electrode disposed on a substrate, an electron emission region electrically coupled to the first electrode, and a second electrode spaced apart from the first electrode, wherein the first electrode includes an opening and an extension that projects into the opening, and the electron emission region is electrically coupled to the first electrode by the extension.

21 Claims, 10 Drawing Sheets

FIG. 11C(ALT.)

ELECTRON EMISSION DEVICE AND ELECTRON EMISSION DISPLAY USING THE ELECTRON EMISSION DEVICE

BACKGROUND OF THE INVENTION

1. Field of the Invention

The present invention relates to an electron emission device and an electron emission display using the electron emission device. More particularly, the present invention relates to an electron emission device configured to enhance electron emission efficiency and an electron emission display using the same.

2. Description of the Related Art

Generally, electron emission devices may be classified according to whether a hot cathode technology or a cold cathode technology is employed to generate electron emission. There are several types of cold cathode-based electron emission devices including, e.g., Field Emission Array (FEA) devices, Surface-Conduction Emission (SCE) devices, Metal-Insulator-Metal (MIM) devices and Metal-Insulator-Semiconductor (MIS) devices.

The FEA devices typically include electron emission regions, and cathode and gate electrodes as driving electrodes. The electron emission regions may be formed of, e.g., a material having a relatively low work function or a relatively large aspect ratio, such as carbonaceous materials or nanometer-sized materials, so that electrons can be effectively emitted when an electric field is applied thereto under a vacuum atmosphere. A region where the cathode and gate electrodes cross may have one or more electron emission regions positioned therein to form a single electron emission element. The electron emission device may include a first substrate having a plurality of the electron emission elements, which may be arranged, e.g., in an array. The electron emission device may be coupled to a light emission device to form an electron emission display. The light emission device may include a second substrate having a phosphor layer, a black layer and an anode electrode. The light emission device may be positioned to face the electron emission device.

In detail, an FEA electron emission display may include a first substrate on which cathode electrodes, an insulating layer and gate electrodes are stacked in sequence. The gate electrodes and the insulating layer may have openings therein that partially expose surfaces of the cathode electrodes. The electron emission regions may be positioned on surfaces of the cathode electrodes that are exposed through the openings.

For each FEA electron emission element, the cathode electrode and the gate electrode may be operated together to generate electron emission from the electron emission region(s) included in the electron emission element. The cathode electrode may provide an electric current that supplies electrons to the electron emission regions for the electron emission. The gate electrode may provide a control signal to control the electron emission by forming an electric field around the electron emission regions, where the electric field results from a voltage difference between the gate and cathode electrodes.

A drawback to the above-described FEA electron emission device is that it may be difficult to properly form the electric field around the electron emission regions. In particular, the electric field may be concentrated on a local region of each electron emission region, e.g., on an outer top edge of the electron emission region, which is closest to the gate electrode. As a result, electrons may be primarily emitted from the local region of the electron emission region, which may lower the efficiency of electron emission. In order to compensate for the lower efficiency, the driving voltage applied to the electron emission device may be increased. However, the increased driving voltage may reduce the service life of the electron emission regions. Therefore, the above-described FEA electron emission device may not be suitable for a high-efficiency electron emission display.

SUMMARY OF THE INVENTION

The present invention is therefore directed to an electron emission device and electron emission display using the electron emission device, which substantially overcome one or more of the problems due to the limitations and disadvantages of the related art.

It is therefore a feature of an embodiment of the present invention to provide an electron emission device configured to exhibit efficient emission of electrons from electron emission regions by effectively forming an electric field around the electron emission regions.

It is therefore another feature of an embodiment of the present invention to provide an electron emission display configured to operate with a relatively low driving voltage, which may increase the service life of the electron emission regions and the display.

At least one of the above and other features and advantages of the present invention may be realized by providing an electron emission device including a first electrode disposed on a substrate, an electron emission region electrically coupled to the first electrode, and a second electrode spaced apart from the first electrode, wherein the first electrode includes an opening and an extension that projects into the opening, and the electron emission region is electrically coupled to the first electrode by the extension.

The opening may include multiple isolated areas and the extension divides the opening into the multiple isolated areas. The isolated areas may be symmetrical with reference to the extension. The extension may have a single member that divides the opening into two isolated areas. The extension may have two members that divide the opening into four isolated areas. The two members may intersect in a center of the opening.

The electron emission region may be formed in one portion. The electron emission region may be partially on the extension and partially on the substrate in the opening. The electron emission region may include multiple portions, each of which is coupled to the extension. The portions of the electron emission region may be symmetrical with reference to the extension. The extension may have a single member that divides the opening into two isolated areas, and the electron emission region may have two portions, each portion contacting an opposite side of the member. The extension may have two crossed members that divide the opening into four isolated areas, and the electron emission region may have four portions, each portion contacting a side of each of the members. The multiple portions may not overlie the extension and may be in electrical contact with side surfaces of the extension. The electron emission region may be formed from a photosensitive material, and the extension may be formed of a non-transparent conductive material.

The second electrode may cross the first electrode, the electron emission region may be disposed in the crossed region, the second electrode may have an opening in the crossed region, and the electron emission region may have a cross-sectional shape that matches the shape of the opening in the second electrode. The electron emission region and the extension may be centered in the opening in the second electrode. A thickness of the electron emission region is greater than that of the first electrode.

At least one of the above and other features and advantages of the present invention may be realized by providing an electron emission display including first and second substrates facing each other and spaced apart from each other, at least one phosphor layer and anode electrode disposed on the second substrate, at least one cathode electrode disposed on the first substrate, at least one electron emission region electrically coupled to the cathode electrode, and at least one gate electrode crossing over the cathode electrode, the gate electrode and the cathode electrode having an insulating layer interposed therebetween, wherein at least one gate opening is formed where the gate electrode and the cathode electrode cross, the gate opening penetrating the gate electrode and the insulating layer, the cathode electrode includes an opening and an extension that projects into the opening, and the electron emission region is electrically coupled to the cathode electrode by the extension.

The opening may include multiple isolated areas and the extension may divide the opening into the multiple isolated areas. The electron emission region may include multiple portions, each of which is coupled to the extension. The electron emission region may be disposed where the gate electrode and the cathode electrode cross, and the electron emission region may have a cross-sectional shape that matches the shape of the gate opening.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF INVENTION

Figure 1A:
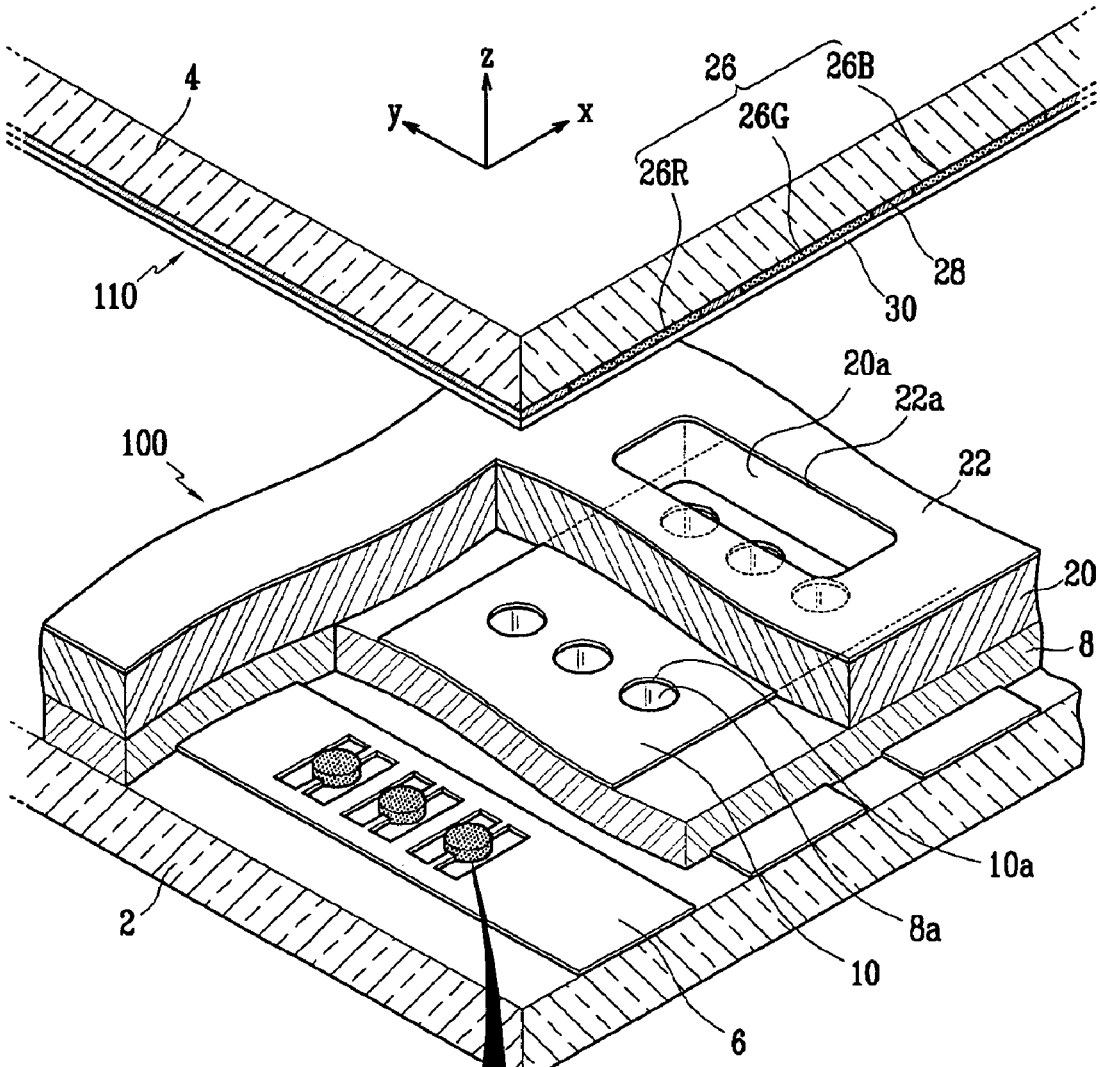
FIGS. 1A and 1B illustrate partial exploded perspective views of an electron emission display according to a first embodiment of the present invention.

Korean Patent Application No. 10-2005-0046201 filed on May 31, 2005, in the Korean Intellectual Property Office, and entitled: "Electron Emission Device" is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. It will also be understood that the term "phosphor" is intended to generally refer to a material that can generate visible light upon excitation by electrons that impinge thereon, and is not intended be limited to materials the undergo light emission through any particular mechanism or over any particular time frame. Like reference numerals refer to like elements throughout.

FIGS. 1A-3 illustrate exploded, sectional and plan views, respectively, of an electron emission display according to a first embodiment of the present invention. Referring to FIGS. 1A-3, the electron emission display may include an electron emission device 100 and a light emission device 110. The electron emission device 100 and the light emission device 110 may include first and second substrates 2 and 4, respectively. The first and second substrates 2 and 4 may be joined and sealed with a sealing member (not shown) provided at the peripheries of the first and the second substrates 2 and 4, thereby forming a sealed vacuum vessel.

The electron emission device 100 may include an array of electron emission elements formed on a surface of the first substrate 2 that faces the second substrate 4. In detail, cathode electrodes 6 may be arranged on the first substrate 2, e.g., in a striped pattern, and a first insulating layer 8 may formed on the first substrate 2 to fully cover the cathode electrodes 6. Gate electrodes 10 may be arranged on the first insulating layer 8 crossing the cathode electrodes 6, e.g., in a striped pattern that crosses the cathode electrodes 6 at right angles. The cathode electrodes 6 may be conductive and may be formed of, e.g., a transparent material such as an indium tin oxide (ITO) or a non-transparent metallic material such as metal such as Ag, Cr, Mo, Al, etc. The choice of cathode electrode material may depend on the method used to form electron emission regions 18. The gate electrodes 10 may be conductive and may be formed of, e.g., a metallic material such as Ag, Cr, Mo, Al, etc.

The crossed regions of the cathode electrodes 6 and the gate electrodes 10 may define pixels. Openings 10*a* in the gates 10 and corresponding openings 8*a* in the first insulating layer 8 define gate openings, which may be positioned at each pixel to partially expose the cathode electrodes 6. In the implementation illustrated in FIGS. 1A-3, a set of three cylindrical holes 8*a* and 10*a*, oriented in a longitudinal direction of the cathode electrode 6, is provided for each pixel, although other suitable shapes and numbers of openings may be provided.

A second insulating layer 20 may be formed on the first insulating layer 8 to cover the gate electrodes 10. Openings 20*a* may correspond to each pixel. Focusing electrode 22 may be formed on the second insulating layer 20. Openings 22*a* in the focusing electrode may correspond to each pixel. The focusing electrode 22 may focus electron beams that are emitted by the emission regions 18. The focusing effect of the focusing electrode 22 may be enhanced by increasing the distance between the focusing electrode 22 and the electron emission regions 18. This distance may be increased by, e.g., increasing the thickness of the second insulating layer 20. The second insulating layer 20 may have a thickness greater than that of the first insulating layer 8.

Describing the pixels in further detail, the cathode electrode 6 may include a bridge member 6*b* extending into an opening 6*a*. Referring to FIG. 1B, the opening 6*a* may include one or more areas adjoining the bridge member 6*b*, such that sides of the bridge member 6*b* are separated from the main body 6*c* of the cathode electrode 6. Referring to FIG. 1B, in an implementation, the bridge member 6*b* may extend from a first side member 6*d* to join the opposite side member $\mathbf{6}d_2$ while dividing the opening 6*a* into two isolated areas $\mathbf{6}a_1$ and $\mathbf{6}a_2$ (note that, in the discussion that follows, isolated areas $\mathbf{6}a_1 \ldots \mathbf{6}a_n$ may be described generically as 6*a*, rather than being individually identified, where the additional detail is not required for an understanding of the present invention). The bridge member 6*b* may be separated from the main body 6*c* of the cathode electrode 6 by the opening areas $\mathbf{6}a_1$ and $\mathbf{6}a_2$. In another implementation (not shown), the bridge member 6*b* may project into the opening 6*a* while not extending all the way across the opening 6*a*, such that the bridge member extends into a single opening 6*a* having, e.g., a horseshoe shape.

The cathode electrode 6 may include sets of openings 6*a* therein that are positioned to correspond to the electron emission regions 18. Pairs of openings 6*a* may be provided in the cathode electrode 6 at positions corresponding to the electron emission regions 18. The openings 6*a* may penetrate the cathode electrode 6 so as expose areas of the first substrate 2 through the cathode electrode 6.

The cathode electrode 6 may include bridge members 6*b* between pairs of openings 6*a*. That is, each bridge member 6*b* of the cathode electrode 6 may define a side of each of two openings 6*a*. The pair of openings 6*a* may be symmetrical with respect to the corresponding bridge member 6*b*. A center of the bridge member 6*b* and centers of the corresponding openings 8*a* and 10*a* in the first insulating layer 8 and the gate electrode 10 may be aligned. The bridge member 6*b* may be oriented with respect to the cathode electrode 6 so as to extend in a longitudinal direction thereof (not shown), or in a lateral direction thereof, i.e., extending in a direction substantially perpendicular to the length direction of the gate electrode 10. That is, as illustrated in FIGS. 1A-3, the openings 6*a* may have longer sides extending in a lateral direction of the cathode electrode 6 and shorter sides extending in a longitudinal direction of the cathode electrode 6, although other suitable arrangements may be provided and the present invention is not limited to the illustrated implementation. For example, the openings 6*a* may be other shapes besides the illustrated rectangles. The pairs of openings 6*a* may be arranged along a longitudinal axis of the cathode electrode 6.

Each electron emission region 18 may be disposed inside a cavity defined by the openings 8*a* and 10*a* in the first insulating layer 8 and the gate electrode 10. The electron emission region 18 may be centered in the openings 8*a* and 10*a*. The electron emission region 18 may be on the first substrate 2 in the openings 6*a* and may be on and electrically connected to the cathode electrode 6. The electron emission region 18 may contact a region of the bridge member 6*b* of the cathode electrode 6. Thus, the electron emission region 18 may cover a central region of the bridge member 6*b* and may partially fill each of the openings 6*a* adjacent to the bridge member 6*b*, so that parts of the electron emission region 18 are spaced apart from the cathode electrode 6 except where the electron emission region 18 is in contact with the bridge member 6*b*.

Figure 3:
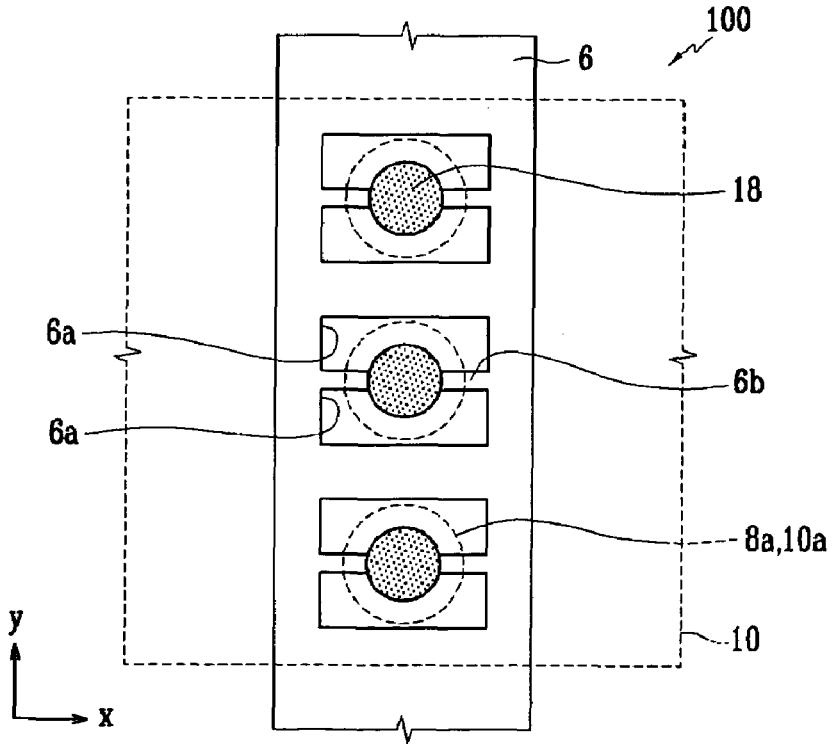
FIG. 3 illustrates a partial plan view of a cathode electrode, gate electrode and electron emission regions of FIG. 1A.

Referring to FIG. 3, the electron emission region 18 may have a plan shape that corresponds to the plan shape of the gate opening defined by openings 8*a* and 10*a*. For example, where the openings 8*a* and 10*a* are circular, the electron emission region 18 may have a circular cross-section, as determined in a plane parallel to the first substrate 2. The electron emission region 18 may be centered in the opening 10*a* with a shape corresponding to the shape of the opening 10*a*, so that outer edges of the electron emission region 18 are substantially equidistant from the inner edges of the gate electrode 10 that define the opening 10*a*.

Figure 2:
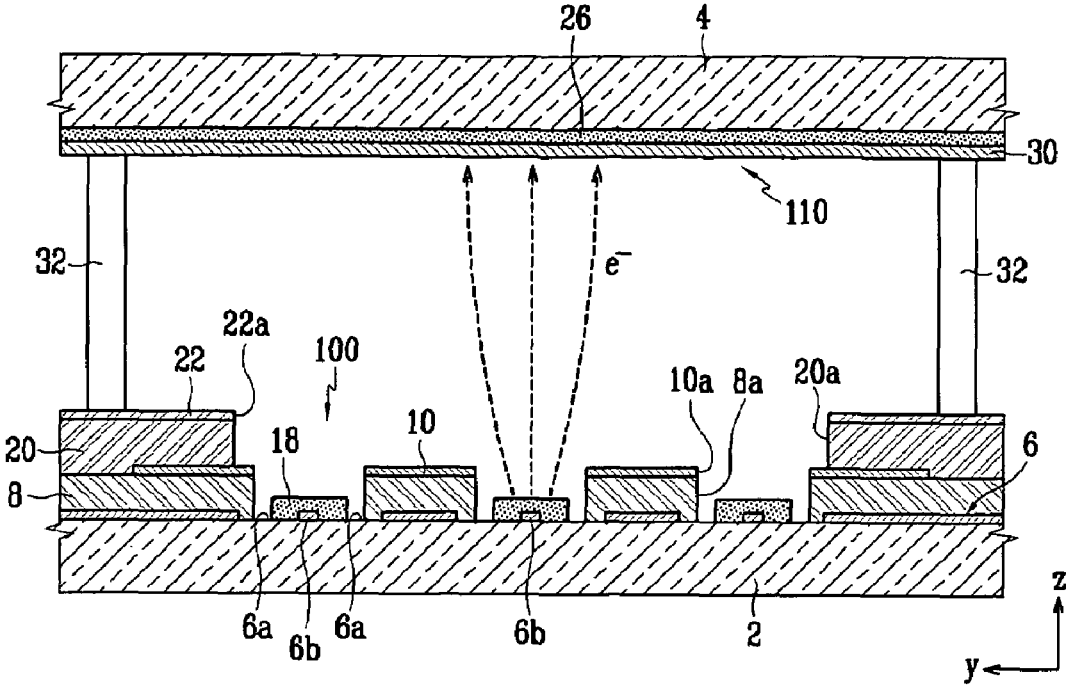
FIG. 2 illustrates a partial sectional view of the electron emission display of FIG. 1A.

The electron emission region 18 may be electrically connected to the cathode electrode 6 through its contact with the bridge member 6*b*, in order to receive an electric current, i.e., a supply of electrons to be emitted, from the cathode electrode 6. Referring to FIG. 2, the electron emission region 18 may contact the exposed top surface and the side surfaces of the bridge member 6*b*, which may reduce contact resistance at the interface with the cathode electrode 6.

The electron emission region 18 may have a thickness greater than the cathode electrode 6 such that the top edges of the electron emission region 18 are elevated above the surface of the cathode electrode 6, which may more effectively induce electron emission upon application of the electric field formed by the voltage difference between the cathode electrode 6 and the gate electrode 10.

The electron emission regions 18 may be formed of a material that can emit electrons when an electric field is applied in a vacuum, e.g., carbon nanotubes, graphite, graphite nanofibers, diamonds, diamond-like carbon, $C_{60}$, silicon nanowires, combinations thereof, etc. The electron emission regions 18 may be formed through suitable processes such as screen printing, chemical vapor deposition, direct growth, sputtering, etc.

In the light emission device 110, phosphor layers 26 may be formed on a surface of the second substrate 4 that faces the first substrate 2. The phosphor layers 26 may include phosphors of various colors, e.g., red (R), green (G) and blue (B) phosphors 26R, 26G and 26B. Where multiple colors of phosphors are provided, each crossed region of the cathode and gate electrodes 14 and 18 may correspond to a single phosphor color. Black layers 28 may be arranged between the phosphor layers 26 in order to enhance the contrast of the display. Where multiple colors of phosphors are provided, the black layers 28 may be formed between them, e.g., between the phosphors 22R, 22G and 22B.

An anode electrode 30 may be disposed on the second substrate 4. The anode electrode 30 may be employed to enhance the screen luminance by applying a high voltage thereto in order to accelerate emitted electrons. The anode electrode 30 may be disposed on the phosphor and black layers 26 and 28, i.e., such that the phosphor and black layers 26 and 28 are between the anode electrode 30 and the second substrate 4. The anode electrode 30 may also reflect visible light that is radiated from the phosphor layers 26 in the direction of the first substrate 2 back through the second substrate 4, which may also enhance the screen luminance. In another implementation (not shown), the anode electrode may be disposed on the second substrate 4, between the phosphor and black layers 26 and 28 and the second substrate 4. The anode electrode may be formed of a conductive material, e.g., aluminum, or, if disposed between the phosphor layers 26 and the second substrate 4, of a transparent conductive material, e.g., Indium Tin Oxide (ITO), or a combination of the two, etc.

The electron emission device 100 and the light emission device 110 may be spaced apart by a predetermined distance to define a vacuum vessel. The electron emission device 100 and the light emission device 110 may be separated by spacers 32 that are disposed between the first and second substrates 2 and 4, as illustrated in FIG. 2. The spacers 32 may maintain a uniform distance between the first and second substrates 2 and 4 even when an external force is applied. The number and arrangement of the spacers 32 may be defined as needed to maintain the space between the first and second substrates 2 and 4. The spacers 32 may be aligned with the black layers 28 in order to reduce the effects of the spacers 32 on the electron emission of the electron emission device 100 and the light emission of the light emission device 110.

The electron emission display may be driven by applying predetermined voltages to the cathode, gate, focusing and anode electrodes 6, 10, 22 and 30. In an implementation, operation of the electron emission display may include applying a scan driving voltage to one of the cathode and gate electrodes 6 and 10, which thus operates as a scan electrode, and applying a data driving voltage to the other of the cathode and gate electrodes 6 and 10, which thus operates as a data electrode.

Electric fields may be formed around the electron emission regions 18 by the voltage difference between the cathode and gate electrodes 6 and 10. When the voltage difference at a given pixel is equal to or greater than a threshold value, electrons ($e^-$ in FIG. 2) may be emitted from the electron emission regions 18.

A voltage of, e.g., 0V or a negative (−) direct current voltage of several volts to tens of volts may be applied to the focusing electrode 22. A positive (+) direct current voltage of, e.g., hundreds of volts to thousands of volts may be applied to the anode electrode 30 in order to accelerate the emitted electrons towards the light emission unit 110. The emitted electrons may impinge on the corresponding phosphor layers 26 of the pixel due to the high voltage applied to the anode electrode 30, thereby exciting the phosphor layers 26. Note that FIG. 2 illustrates only a single electron emission region 18 emitting electrons, but this is merely for convenience of illustration and in operation electrons may be simultaneously emitted from each of the three electron emission regions 18.

According to this embodiment of the present invention, since the electron emission region 18 may be disposed on the first substrate 2 and may partially fill the opening 6*a*, the electric field may effectively extend upward from the electron emission region 18 as well sideways from the electron emission region 18. Therefore, the electric field may be intensively concentrated around the electron emission region 18.

Figure 1B:
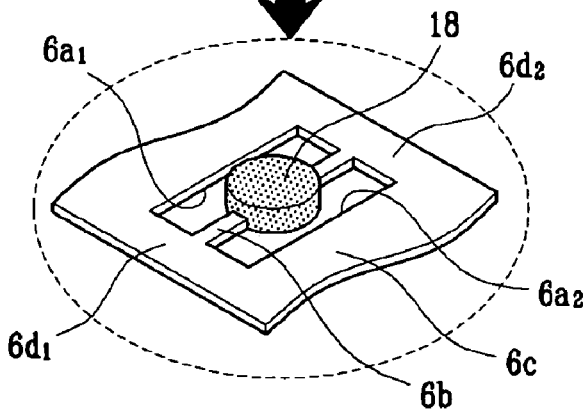
Figure 4A:
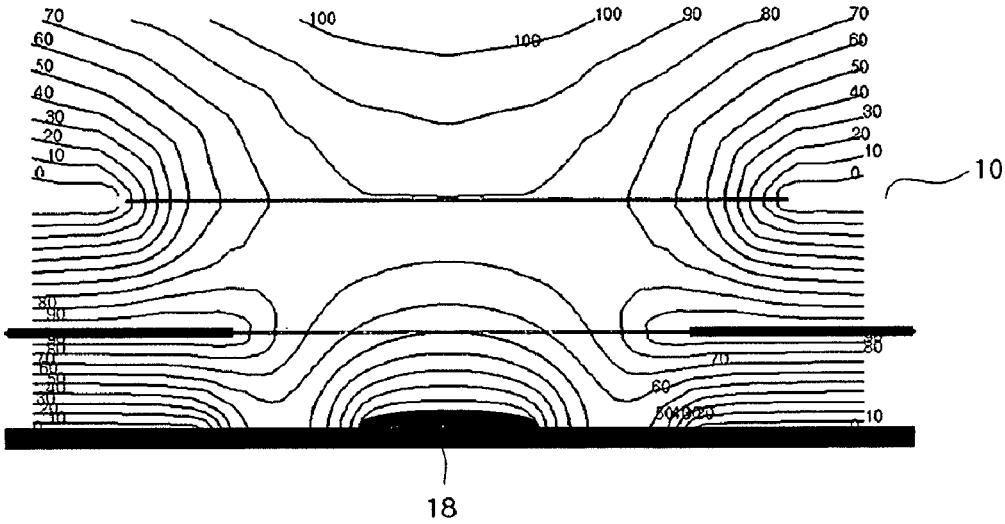
FIGS. 4A and 4B illustrate results of a computer simulation with respect to electric potential distribution and electron emission locus for electron emission regions of the electron emission display according to the embodiment of FIG. 1A.
Figure 4B:
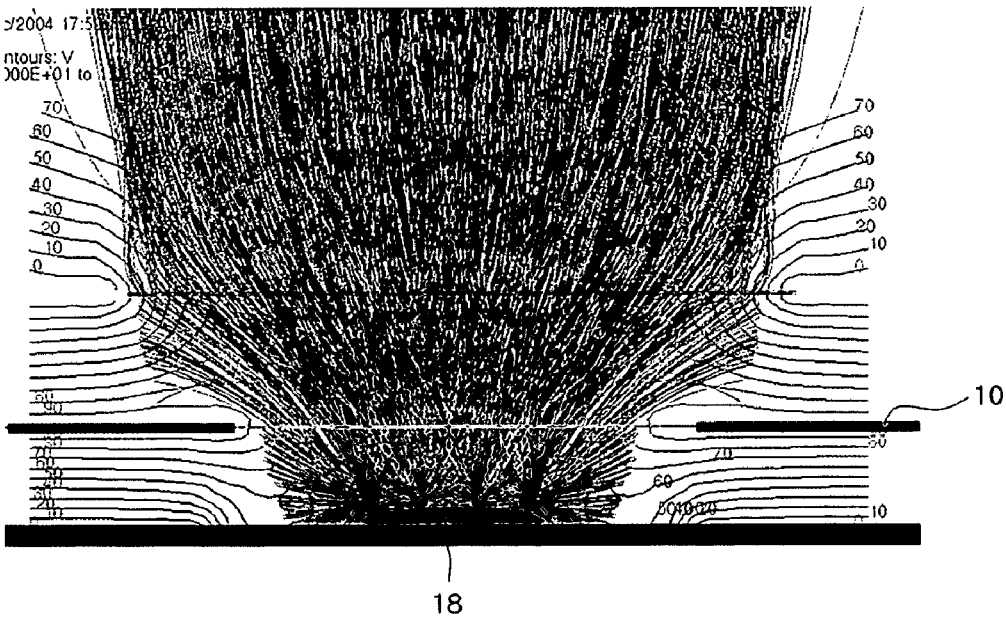

FIGS. 4A and 4B illustrate results of a computer simulation with respect to electric potential distribution and electron emission locus for electron emission regions of the electron emission display according to the embodiment of FIG. 1A. Referring to FIG. 4A, the equipotential lines are densely formed around the electron emission region 18 and enclose the top and sides of the electron emission region 18. That is, the electric field is strongly formed around the electron emission region 18. Thus, in this embodiment, since the electron emission region 18 is disposed on the first substrate 2 partially filling the opening 6*a*, the electric field effectively extends upward and sideways from the electron emission region 18. Therefore, the electric field is strongly concentrated around the electron emission region 18.

Figure 5A:
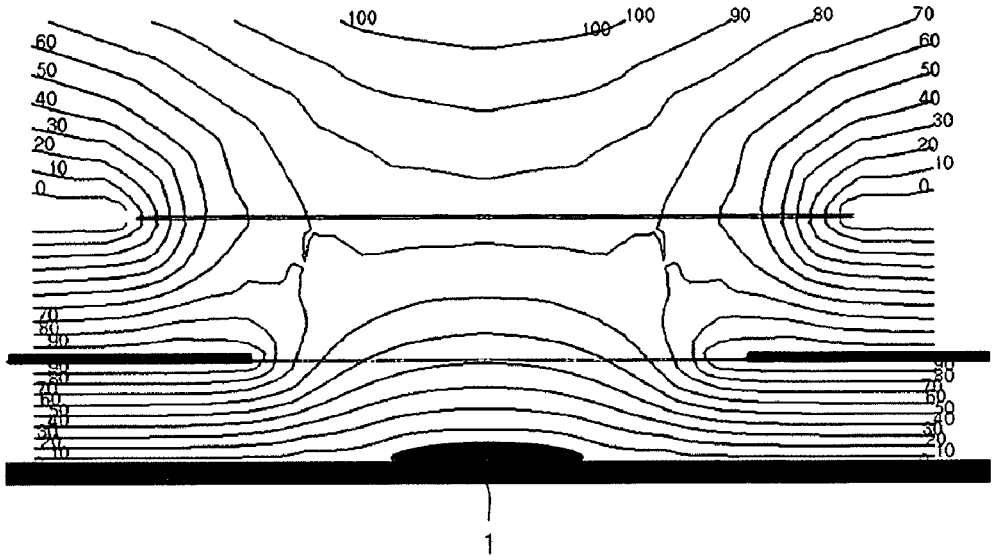
FIGS. 5A and 5B illustrate results of a computer simulation with respect to electric potential distribution and electron emission locus for electron emission regions of a comparative electron emission display.
Figure 5B:
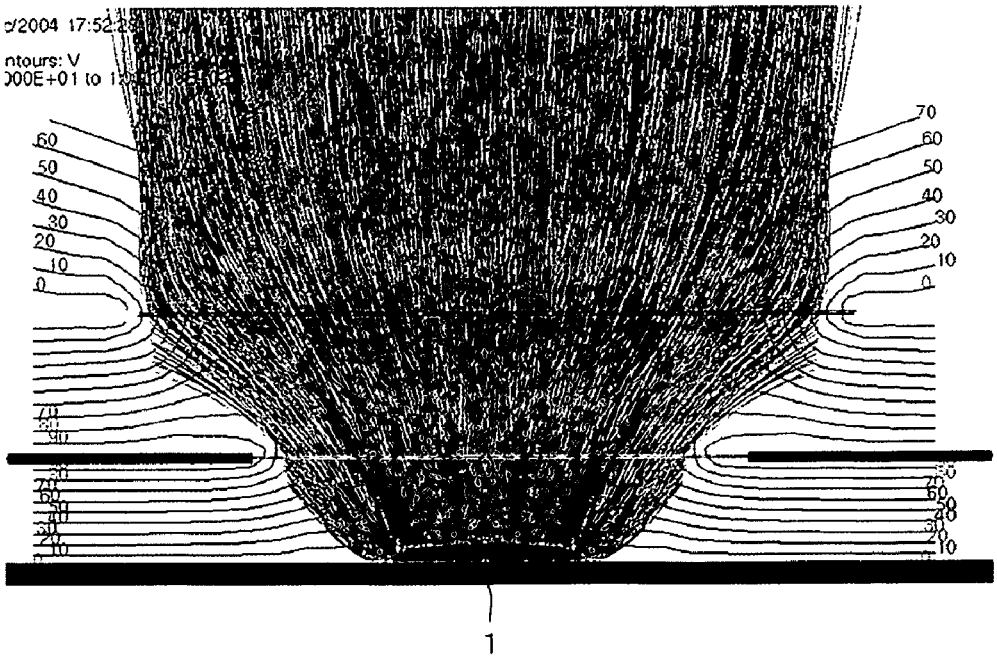

In contrast, FIGS. 5A and 5B illustrate results of a computer simulation with respect to electric potential distribution and electron emission locus for electron emission regions of a comparative electron emission display, wherein the cathode electrode is not patterned with openings and bridge members, and the emission regions are disposed entirely on the cathode electrode. Referring to FIG. 5A, in the comparative example the equipotential lines do not wrap around the electron emission region 1, and thus a relatively weak electric filed is formed around the electron emission region 1. That is, as illustrated in FIG. 5A, the equipotential lines closest to the electron emission region 1 extend laterally, generally following a contour of the cathode electrode (not shown). In contrast, in the embodiment of the present invention that is simulated in FIG. 4A, the equipotential lines wrap around the electron emission region 18 so as to be substantially perpendicular to the cathode electrode.

Figure 6:
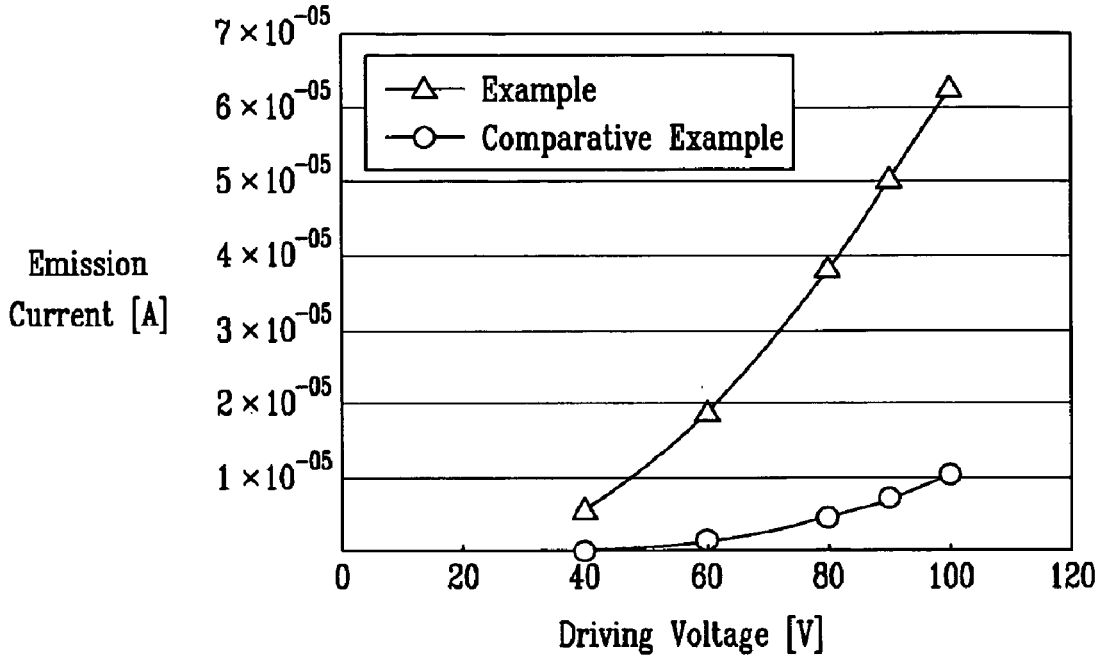
FIG. 6 illustrates graphs of emission current variation with respect to driving voltage for the electron emission display according to the embodiment of FIG. 1A and for a comparative electron emission display.

FIG. 6 illustrates graphs of emission current variation with respect to driving voltage for the electron emission display according to the embodiment of FIG. 1A and for a comparative electron emission display. Referring to FIG. 6, for the same applied driving voltage, the emission current of the electron emission display according to the embodiment of FIG. 1A is greater than that of the comparative electron emission display.

In particular, the electron emission display according to the first embodiment of the present invention may effectively concentrate the electric field on the surface of the electron emission region 18, as described above, so as to enhance the efficiency of electron emission. That is, the amount of electrons emitted at each pixel may increase, thereby enhancing the luminance of the electron emission display. Accordingly, enhanced luminance may be achieved without undesirable increases in the driving voltage, while power consumption may be reduced and the service life of the electron emission region 18 may be extended. Moreover, as shown in FIG. 6, the driving voltages for the cathode and gate electrodes of the electron emission display according to the embodiment of FIG. 1A may be lowered by about 10-30% as compared with the comparative electron emission display while maintaining the same emission current.

Figure 7:
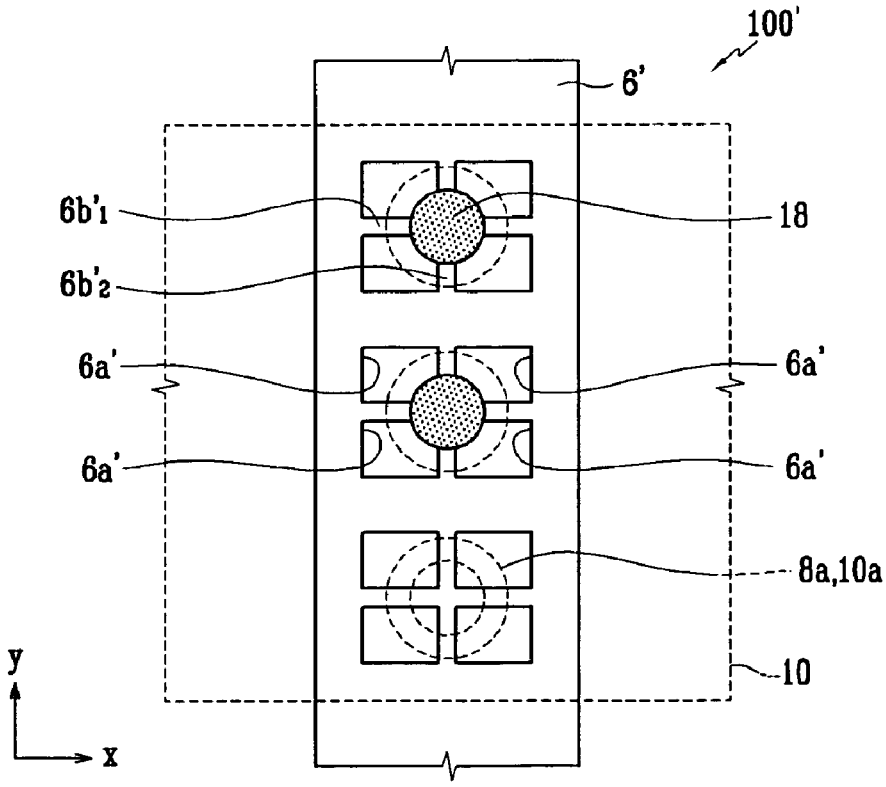
FIG. 7 illustrates a partial top view of a cathode electrode, gate electrode and electron emission regions of an electron emission device according to a second embodiment of the present invention.

FIG. 7 illustrates a partial top view of a cathode electrode, gate electrode and electron emission regions of an electron emission device according to a second embodiment of the present invention. The following discussion will focus on the differences between the first and second embodiments.

Referring to FIG. 7, a cathode electrode 6' of an electron emission device 100' may include multiple bridge members 6*b*' and multiple openings 6*a*'. In an implementation, the cathode electrode 6' may have two bridge members $6b'_1$ and $6b'_2$ defining four openings 6*a*', as illustrated in FIG. 7 (note that, in the discussion that follows, individual bridge members $6b'_1 \ldots 6b'_n$ may be described generically as 6*b*', rather than being individually identified, where the additional detail is not required for an understanding of the present invention).

The bridge members 6*b*' and the openings 6*a*' may be positioned so as to correspond to the openings 8*a* and 10*a* in the first dielectric layer 8 and the gate electrode 10. The bridge members 6*b*' may each extend under the electron emission region 18. Accordingly, in the second embodiment there may be a greater interface between the electron emission region 18 and the cathode electrode 6' than in the first embodiment, assuming other factors are constant. Thus, the contact resistance between the cathode electrode 6' and the electron emission region 18 may be reduced.

The bridge members 6*b*' may be oriented, e.g., substantially perpendicular to each other. For example, the two bridge members $\mathbf{6}b'_1$ and $\mathbf{6}b'_2$ may intersect to form a cross shape, as illustrated in FIG. 7. The electron emission region 18 may be centered at the intersection of the bridge members 6*b*'. The four openings 6*a*' may be symmetrically formed about the bridge members 6*b*'. The electron emission region 18 may be centered in the openings 8*a* and 10*a*. The electron emission region 18 may extend into and partially fill the openings 6*a*', and may be in contact with the underlying first substrate 2 in these areas. That is, except for where the electron emission region 18 is in contact with the bridge members 6*b*', the electron emission region 18 may be spaced apart from the rest of the cathode electrode 6'.

Figure 8A:
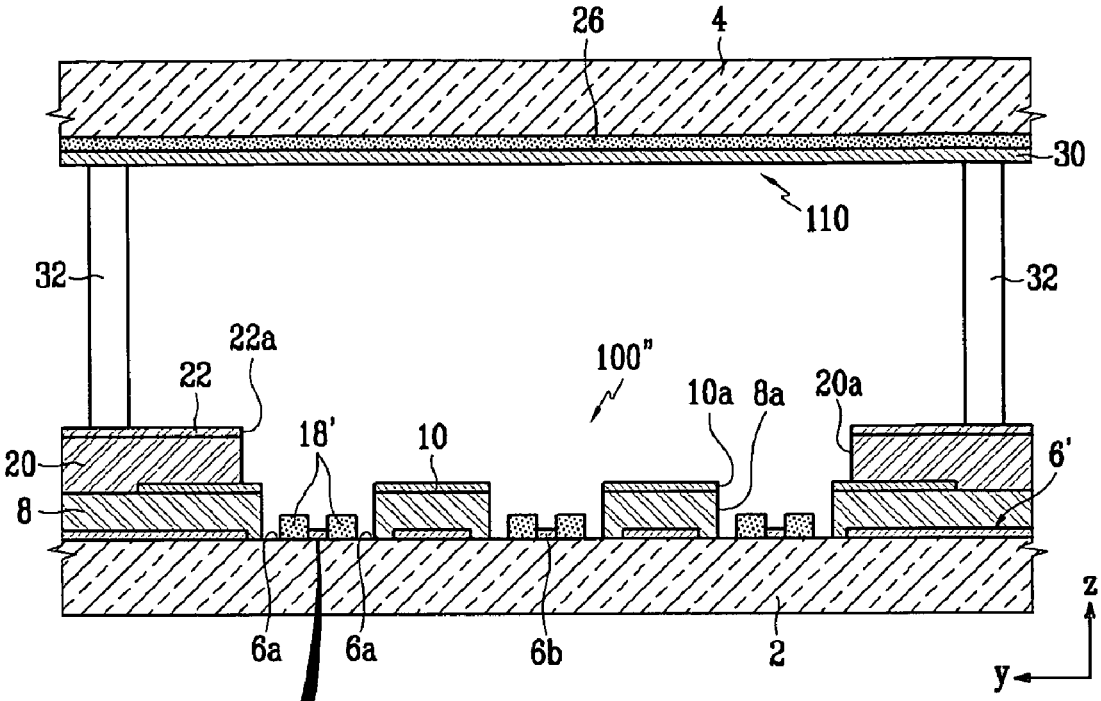
FIGS. 8A and 8B illustrate partial sectional views of an electron emission display according to a third embodiment of the present invention.
Figure 8B:
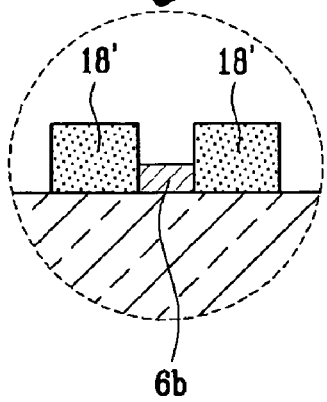
Figure 9:
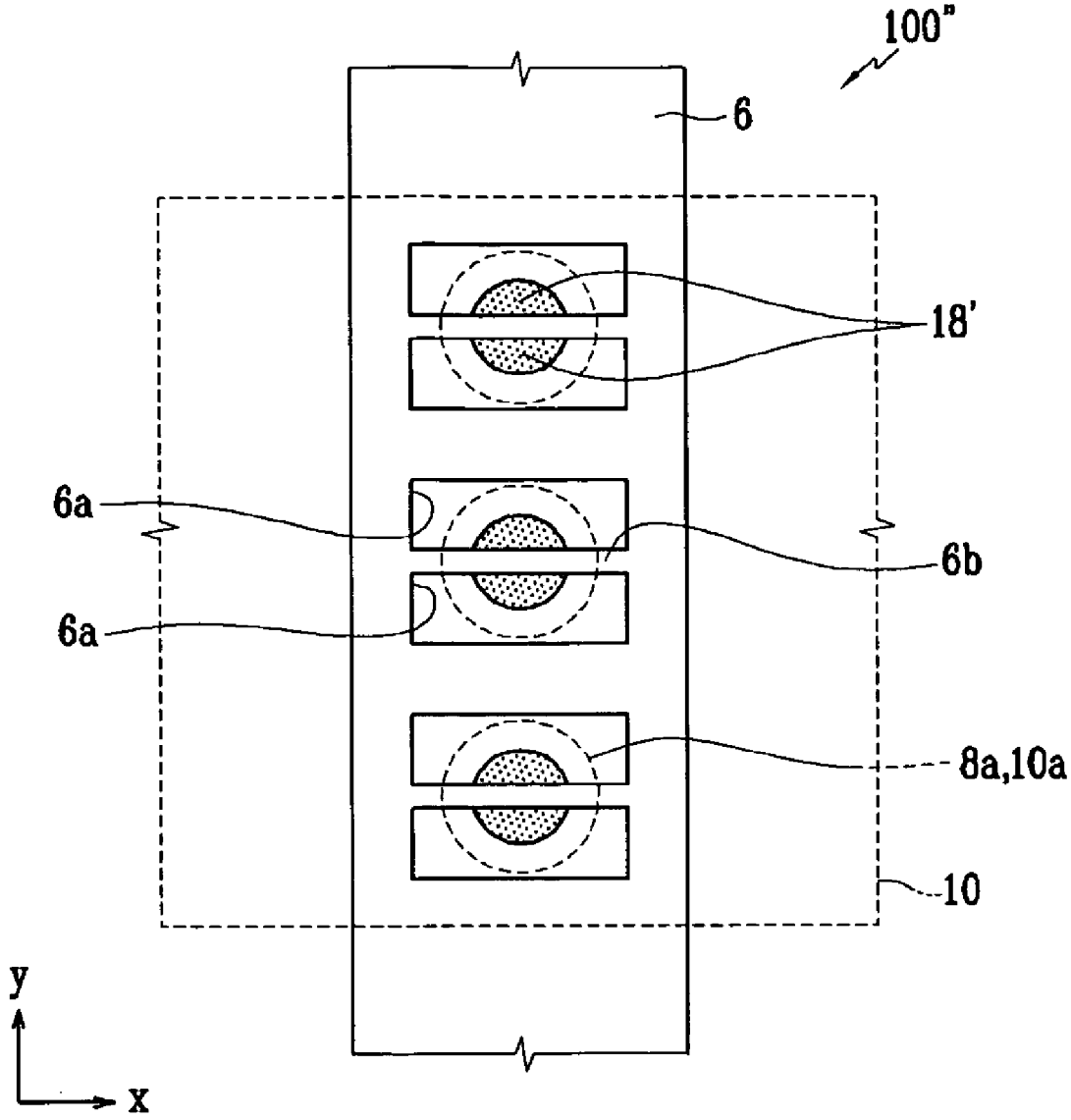
FIG. 9 illustrates a partial top view of a cathode electrode, gate electrode and electron emission regions of FIG. 8A.

FIGS. 8A and 8B illustrate partial sectional views of the electron emission display according to a third embodiment of the present invention, and FIG. 9 illustrates a partial top view of a cathode electrode, gate electrode and electron emission regions of FIG. 8A. The following discussion will focus on the differences between the first and third embodiments.

Referring to FIGS. 8A, 8B and 9, an electron emission device 100" may include electron emission regions 18' formed in multiple portions. The portions of the electron emission region 18' may be disposed on the first substrate 2. In an implementation, each portion of the electron emission region 18' may partially overlap the upper surface of the cathode electrode 6 (not shown). Alternatively, each portion of the electron emission region 18' may not overlap the upper surface of the cathode electrode 6, as illustrated in FIGS. 8A, 8B and 9. That is, referring to FIG. 8B, the multiple portions of the electron emission region 18' may make electrical contact with the cathode electrode 6 only along sides thereof, in particular, along sides of the bridge member 6*b*. In an implementation, the each portion of the electron emission region 18' may contact a side of the bridge member 6*b* at the center thereof, and may fill central areas of the openings 6*a* that abut the bridge member 6*b*. Widths of the openings 6*a* may be greater than the corresponding widths of the portions of the electron emission region 18', such that the portions of the electron emission region 18' are spaced apart from the rest of the cathode electrode 6 except where the portions of the electron emission region 18' contact sides of the bridge member 6*b*.

The cross-sectional shapes of the portions of the electron emission region 18' may be configured to correspond to shape of the opening 10*a* in the gate electrode 10. In particular, the top outer edges of the portions of the emission region 18' may have substantially the same shape as the opening 10*a*, so as to maintain a substantially uniform distance between the gate 10 and the emission region 18'. For example, where the cross-section of the opening 10*a* is circular, each portion of the electron emission region 18' may be semicircular.

In the electron emission region 18' according to the third embodiment of the present invention, the multiple portions of the electron emission region 18' may increase the effective length of the edge, which is where the electron emission strongly occurs. Thus, as compared with the electron emission region 18 of FIG. 1A, the emission efficiency may be enhanced. In addition, according to the third embodiment of the present invention, the electric field may be more effectively concentrated on the top edge portion of the electron emission region 18' facing the bridge member 6*b*, thus further enhancing electron emission efficiency.

The multi-portioned structure of the electron emission region 18' may be formed by the same processes described above regarding the electron emission region 18 of the first embodiment, and may be particularly suitable for electron emission devices that employ a cathode electrode formed of an opaque material. In particular, the electron emission region 18' may be formed using a photosensitive material, since the electron emission region 18' need not overlie the top surface of the bridge member 6*b*. The opaque material for the cathode electrode 6 may be, e.g., a metal such as Ag, Cr, Mo, Al, etc., which may exhibit a lower resistance than ITO and reduce or eliminate a voltage drop occurring along the length of the cathode electrode 6.

Figure 10:
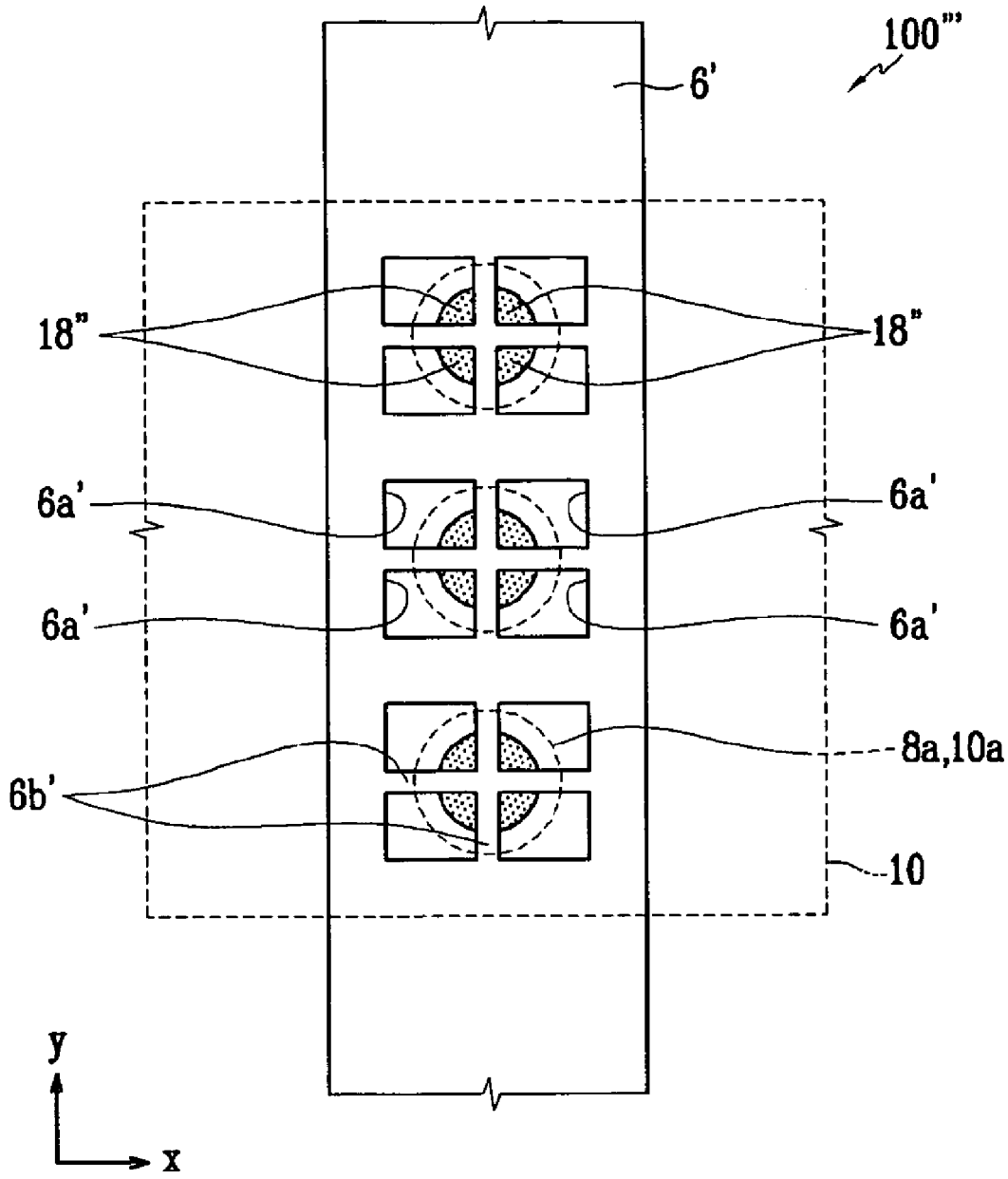
FIG. 10 illustrates a partial top view of a cathode electrode, gate electrode and electron emission regions of an electron emission device according to a fourth embodiment of the present invention.

FIG. 10 is a partial top view of a cathode electrode, gate electrode and electron emission regions of an electron emission device according to a fourth embodiment of the present invention. The fourth embodiment may include aspects of the second and third embodiments described above. In particular, referring to FIG. 10, an electron emission device 100'" may include the cathode electrode 6' having multiple bridge members 6*b*' and an electron emission region 18' having multiple portions.

The portions of the electron emission region 18" may not cover top surfaces of the bridge members 6*b*', while contacting side surface of the bridge members 6*b*'. The portions of the electron emission region 18" may partially fill the openings 6*a*' where they abut the bridge members 6*b*'. An individual portion of the electron emission region 18" may be provided in each of the multiple openings 6*a*'. The portions of the electron emission region 18" may be spaced apart from the cathode electrode 6', except where the portions of the electron emission region 18" contact sides of the bridge members 6*b'*.

In an implementation, four openings 6*a*' may be formed in a region of cathode electrode 6' that is exposed through openings 8*a* and 10*a* in the first insulating layer 8 and the gate electrode 10. Two bridge members 6*b*' may intersect to form a cross shape defining sides of the openings 6*a*'. The two bridge members 6*b*' may define four openings 6*a*', which may be symmetrical with respect to the crossed bridge members 6*b'*.

Similar to the electron emission region 18' of FIG. 9, the electron emission region 18" of the fourth embodiment may have an increased effective length of the edges where electron mission intensively occurs, as a result of the multiple portions making up the electron emission region 18". Thus, electron emission efficiency may be further enhanced. In addition, since the electric field may be effectively concentrated on the top edges of the portions of the electron emission region 18" that face the bridge members 6*b*', the emission efficiency may be further enhanced.

A method of forming electron emission regions for the above-described embodiments will now be explained with reference to FIGS. 11A-11C and 11C (ALT.), which illustrate partial sectional views of stages in a method of making an electron emission device according to the present invention.

Figure 11A:
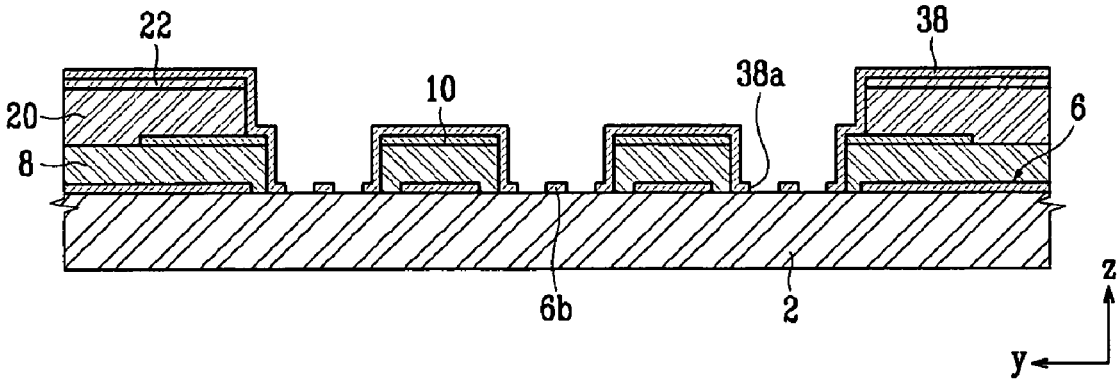
FIGS. 11A-11C and 11C (ALT.) illustrate partial sectional views of stages in a method of making an electron emission device according to the present invention.

Referring to FIG. 11A, the cathode electrodes 6, the first insulating layer 8, the gate electrodes 10, the second insulating layer 20 and the focusing electrode 22 may be formed on the first substrate 2. A sacrificial layer 38 may be formed on a surface of the resultant structure. The sacrificial layer 38 may be patterned to form openings 38*a*. The locations of the openings 38*a* may correspond to where electron emission regions will be formed.

Figure 11B:
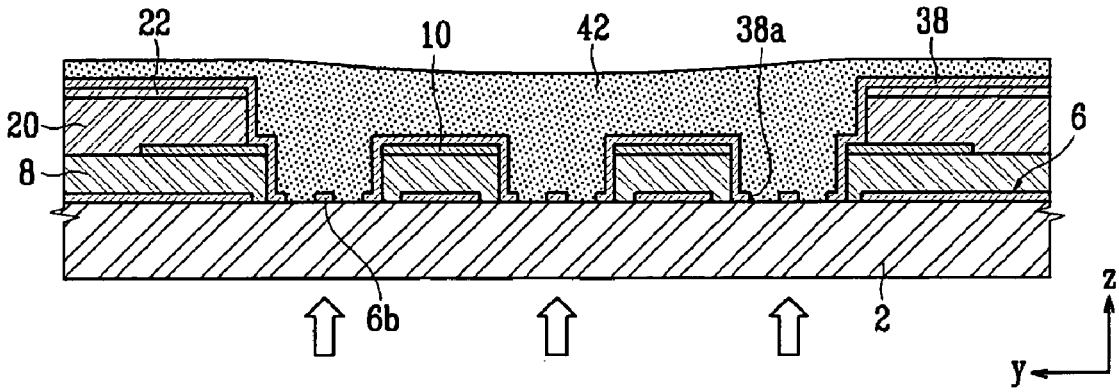
Figure 11C:
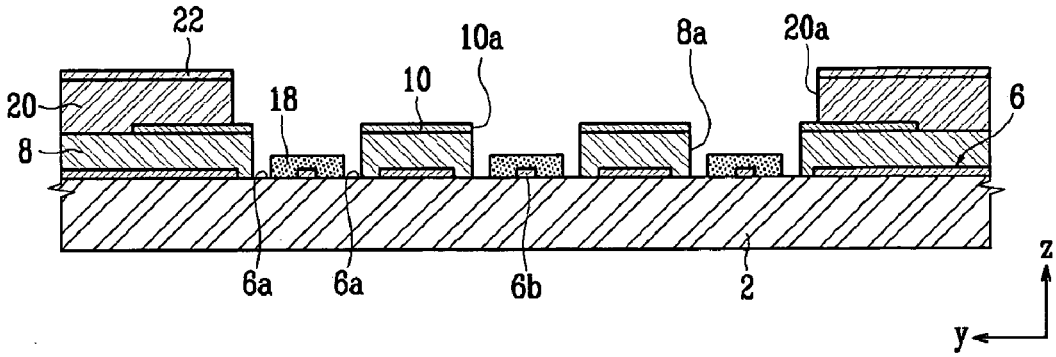
Figure 11C:
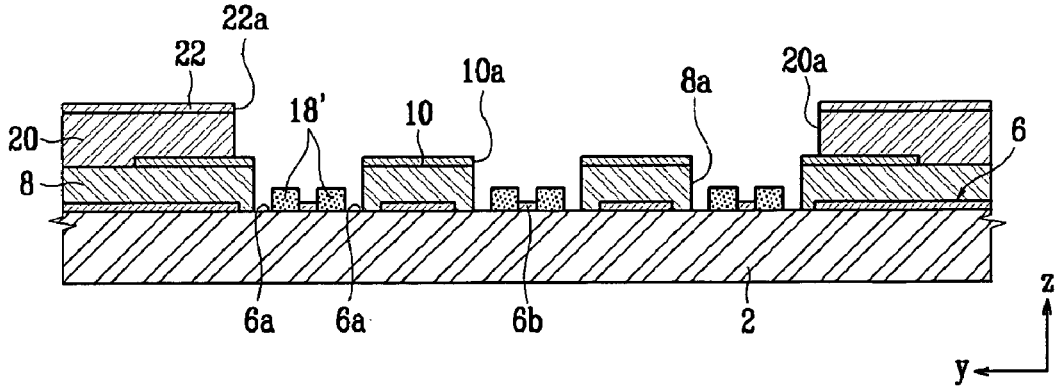

Referring to FIG. 11B, a paste 42 containing an electron emission material and a photosensitive material may be deposited across the first substrate 2. Where the first substrate transmits ultraviolet (UV) light, UV light may be illuminated through a rear surface of the first substrate 2 to harden the paste 42. Thus, the paste 42 may be hardened in the areas corresponding to the openings 38*a* in the sacrificial layer 38. Then, the sacrificial layer 38 and any non-hardened paste 42 may be removed, and the remaining hardened paste 42 may be dried and fired to form the electron emission regions 18.

The cathode electrodes 6 may have openings 6*a* aligned with the openings 38*a*, thus allowing the UV light to pass though the openings 6*a* and 38*a* and hardening the paste 42. Moreover, as illustrated in FIG. 11C, the cathode electrodes 6 may be formed of a transparent material, e.g., ITO, that transmits the ultraviolet light. Thus, the paste 42 may be hardened even where it overlies the bridge members 6*b*, as the bridge members 6*b* transmit the ultraviolet light. Therefore, the electron emission regions 18 may be formed on the top surfaces of the bridges 6*b* even when using backside UV light exposure to pattern the paste 42. In another implementation, as illustrated in FIG. 11C (ALT.), the cathode electrodes 6 may be formed of a material that does not transmit UV light. In this case, the paste 42 may not be hardened where it overlies the bridge members 6*b*, thereby forming electron emission regions having multiple portions, e.g., electron emission regions 18'.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission device, comprising:

a first electrode disposed on a substrate;

an electron emission region electrically coupled to the first electrode; and a second electrode spaced apart from the first electrode, wherein:

the first electrode includes an opening and an extension that projects into the opening, the electron emission region is electrically coupled to the first electrode by the extension, the electron emission region is spaced apart from peripheral edges of the opening, and the opening includes multiple isolated areas and the extension divides the opening into the multiple isolated areas.

2. The electron emission device as claimed in claim 1, wherein the isolated areas are symmetrical with reference to the extension.

3. The electron emission device as claimed in claim 1, wherein the extension has a single member that divides the opening into two isolated areas.

4. The electron emission device as claimed in claim 1, wherein the extension has two members that divide the opening into four isolated areas.

5. The electron emission device as claimed in claim 4, wherein the two members intersect in a center of the opening.

6. The electron emission device as claimed in claim 1, wherein the electron emission region is formed in one portion.

7. The electron emission device as claimed in claim 6, wherein the electron emission region is partially on the extension and partially on the substrate in the opening.

8. The electron emission device as claimed in claim 1, wherein the electron emission region includes multiple portions, each of which is coupled to the extension.

9. The electron emission device as claimed in claim 8, wherein the portions of the electron emission region are symmetrical with reference to the extension.

10. The electron emission device as claimed in claim 8, wherein the extension has two crossed members that divide the opening into four isolated areas, and the electron emission region has four portions, each portion contacting a side of each of the members.

11. The electron emission device as claimed in claim 8, wherein the multiple portions do not overlie the extension and are in electrical contact with side surfaces of the extension.

12. The electron emission device as claimed in claim 8, wherein the electron emission region is formed from a photosensitive material, and the extension is formed of a non-transparent conductive material.

13. The electron emission device as claimed in claim 1, wherein the extension has a single member that divides the opening into two isolated areas, and the electron emission region has two portions, each portion contacting an opposite side of the member.

14. The electron emission device as claimed in claim 1, wherein the second electrode crosses the first electrode, the electron emission region is disposed in the crossed region, the second electrode has an opening in the crossed region, and the electron emission region has a cross-sectional shape in a plane parallel to a major surface of the substrate that matches a cross-sectional shape of the opening in the second electrode in a plane parallel to the major surface of the substrate.

15. The electron emission device as claimed in claim 14, wherein the electron emission region and the extension are centered in the opening in the second electrode.

16. The electron emission device as claimed in claim 1, wherein a thickness of the electron emission region is greater than that of the first electrode.

17. The electron emission device as claimed in claim 1, wherein the electron emission region is electrically coupled to the first electrode by the extension alone.

18. An electron emission display, comprising:

first and second substrates facing each other and spaced apart from each other;

at least one phosphor layer and anode electrode disposed on the second substrate;

at least one cathode electrode disposed on the first substrate;

at least one electron emission region electrically coupled to the cathode electrode; and at least one gate electrode crossing over the cathode electrode, the gate electrode and the cathode electrode having an insulating layer interposed therebetween, wherein:

at least one gate opening is formed where the gate electrode and the cathode electrode cross, the gate opening penetrating the gate electrode and the insulating layer, the cathode electrode includes an opening and an extension that projects into the opening, the electron emission region is electrically coupled to the cathode electrode by the extension, the electron emission region is spaced apart from peripheral edges of the opening, and the opening includes multiple isolated areas and the extension divides the opening into the multiple isolated areas.

19. The electron emission display as claimed in claim 18, wherein the electron emission region includes multiple portions, each of which is coupled to the extension.

20. The electron emission display as claimed in claim 19, wherein the electron emission region is disposed where the gate electrode and the cathode electrode cross, and the electron emission region has a cross-sectional shape in a plane parallel to a major surface of the first substrate that matches a cross-sectional shape of the gate opening in a plane parallel to the major surface of the first substrate.

21. The electron emission display as claimed in claim 18, wherein the electron emission region is electrically coupled to the cathode by the extension alone.

* * * * *